US005414326A

United States Patent [19]

Yang

[11] Patent Number: 5,414,326

[45] Date of Patent: May 9, 1995

[54] SEQUENTIAL ON-OFF TYPE SERIAL LAMP SET CONSTRUCTED BY VARIED THERMO DELAY TIME CONSTANT

[76] Inventor: Tai-Her Yang, 5-1 Taipin St., Si-Hu Town, Dzan-Hwa, Taiwan, Prov. of China

[21] Appl. No.: 962,121

[22] Filed: Oct. 16, 1992

[51] Int. Cl.[6] ..... H05B 37/00

[52] U.S. Cl. ..... 315/185 R; 315/185 S; 315/186; 315/200 A; 315/DIG. 5

[58] Field of Search ..... 315/200 A, 185 R, 185 S, 315/186, 241 P, 306, DIG. 1, DIG. 5; 362/11, 13, 15, 211, 212

[56] References Cited

U.S. PATENT DOCUMENTS

| | | | |
|---|---|---|---|
| 2,272,523 | 2/1942 | Inman | 315/185.5 |
| 3,862,434 | 1/1975 | Davis, Jr. | 315/185.5 X |
| 3,895,265 | 7/1975 | Watrous | 315/241 P X |
| 3,898,512 | 8/1975 | Buck | 315/241 P X |
| 4,375,634 | 3/1983 | Leis | 315/200 A X |
| 5,164,636 | 11/1992 | Allaire | 315/200 A |

*Primary Examiner*—Robert J. Pascal
*Assistant Examiner*—Haissa Philogene
*Attorney, Agent, or Firm*—Leonard Bloom

[57] ABSTRACT

A flashing lamp set includes a plurality of gas-filled filament bulbs (101) having respective rise-time constants which are different from each other, thereby providing different thermo-optical effects. When power is supplied, the lamps are illuminated in sequence for security purposes or for a decorative effect.

1 Claim, 1 Drawing Sheet

SEQUENTIAL ON-OFF TYPE SERIAL LAMP SET CONSTRUCTED BY VARIED THERMO DELAY TIME CONSTANT

SUMMARY OF THE INVENTION

The present invention relates to an improvement for a low-cost flashing type serial lamp set which is constructed of a plurality of filament type bulbs being serial or parallel (or both serial and parallel) and concerning specific thermo delay time constant to give an effect of differential sequence luminesce, As we know that a thermal type bulb is involved in thermal/optical time difference due to thermo capacity's influence from electricity delivery till lighting up in respect of structural factors such as the variety of filament and filling gas, etc. because different thermal capacity for the filament varies time difference, With reference to such characteristics, the sequential ON-OFF type serial lamp set constructed by varied thermo delay time constant is provided for warning or decoration purpose, etc.

DETAILED DESCRIPTION OF THE INVENTION

Figure 1:
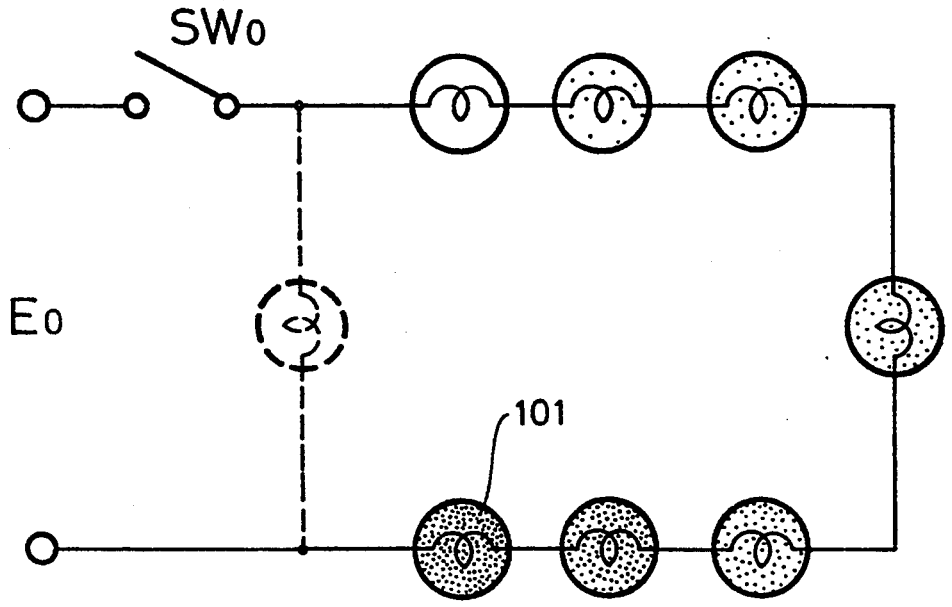
FIG. 1 is a parallel embodiment of a sequential ON-OFF type serial lamp set constructed by varied thermo delay time constant.

In general the conventional sequential ON-OFF serial lamp set is to create visually motive feeling through the effect of ON-OFF lighting and thus is widely applied to warning lamp, commercial lamp or decorative lamp. However, most conventional sequential ON-OFF type serial lamp set used to establish control for serial lamp set individually through control switch for time difference control so as to secure visually motive feeling from sequential ON-OFF. Nevertheless, individual control increases the production cost comparatively, and a number of parts also increases the possibility of trouble, To overcome said defects the present invention relates to provide a sequential ON-OFF type serial lamp set established through varied thermo delay time constant.

As we know thermal type bulb, due to the structure of filament and stuff gas, etc. having thermo capacity resulting in having thermo/optical time difference from power delivery to lighting; the filament structure with different thermo capacity shall have different time difference. Based on said characteristics the present invention relates to a sequential ON-OFF type serial lamp set being established through varied thermo delay time constant.

The present invention is thus described in company with the drawings,

FIG. 1 is a parallel embodiment of the invention comprising:

a control switch SWO being serial between the load and power supply EO and allowed to be mechanical-electronic type or solid-state electronic elements and driven by manpower or electrical energy, and an independent switch or controlled by additional control signal;

lamp set appearing at least two or more specific thermo/optical time difference, being serial or parallel (or combined) and especially the potential of thermo/optical time difference in a quick-to-slow (or slow-to-quick) sequence; once electricity is transmitted the lamps lit up in sequence to create visually motive effect; for practical application, it may include an alternative arrangement or arrangement in a specific sequence for the lamps and further chain with automatic reflex type delay breaker for lighting ON/OFF in cyclic sequence to produce a visually motive effect.

Wherein each lamp set that concerns a specific thermo/optical time difference is characterized as follows:

stuff gases 101 of different inertia vary in thermo/optical time difference;

filament set with different thermal capacity to secure different thermo delay time constant;

filament set distributed in different manner to form different thermal field and construct sequential ON-OFF type serial lamp set by means of different thermo rise time constant;

Said lamp set constructed in a combinational manner concerning single or a multitude of characteristics appears sequential ON-OFF visually motive effect when it is electricized. For practical production, each lamp can be marked with predetermined thermo/optical time or marked with the number for selection; for practical application, lamp set may appear series or parallel (or combined) and especially the potential of thermo/optical time difference in a quick-to-slow (or slow-to-quick) sequence; once electricity is transmitted the lamps lit up in sequence to create visually motive effect; for practical application, it may include an alternative arrangement or arrangement in a specific sequence for the lamps and further chain with automatic reflex type delay breaker for lighting ON/OFF in cyclic sequence to produce a visually motive effect.

To conclude above-mentioned statement, the sequential ON-OFF serial lamp set constructed through thermo delay time constant according to the present invention concerns a simple structure, reliable performance and definite function please exam it in accordance with the law.

I claim:

1. A flashing lamp set comprising at least a pair of lamps, a power source and switching means for connecting the power source to the lamps, wherein the lamps have different respective capabilities to emit light in response to power supplied thereto, such that the lamps become illuminated in sequence, wherein the lamps comprise gas-filled filament lamps, wherein the lamps are connected in series with each other and with the power source and switching means, wherein the lamps are connected with each other in a desired sequence according to a respective distinctive capability of each of said pair of lamps to emit light in response to the power supplied thereto, wherein each of the gas-filled filament lamps has a distinctive respective gas, and wherein each of the gas-filled filament lamps has a distinctive respective filament shape.

* * * * *